US007284680B2

(12) United States Patent
Farano et al.

(10) Patent No.: US 7,284,680 B2
(45) Date of Patent: Oct. 23, 2007

(54) ELECTROVALVE DISPENSER DEVICE FOR A REFRIGERATOR

(75) Inventors: Michele Farano, Turin (IT); Paolo Da Pont, Turin (IT)

(73) Assignee: ELBI International S.p.A., Torino (IT)

( * ) Notice: Subject to any disclaimer, the term of this patent is extended or adjusted under 35 U.S.C. 154(b) by 567 days.

(21) Appl. No.: 10/948,457

(22) Filed: Sep. 24, 2004

(65) Prior Publication Data

US 2005/0087561 A1 Apr. 28, 2005

(30) Foreign Application Priority Data

Sep. 25, 2003 (IT) ..... TO2003A0747

(51) Int. Cl.
*B67D 5/08* (2006.01)

(52) U.S. Cl. ..... 222/52; 222/14; 222/63; 222/144.5; 222/146.6; 222/504; 137/883

(58) Field of Classification Search ..... 222/14, 222/42, 52, 63, 504, 146.6, 639, 144.5, 129.1, 222/129.2, 129.3, 129.4; 137/883, 601.13, 137/601.14

See application file for complete search history.

(56) References Cited

U.S. PATENT DOCUMENTS 5,429,272 A * 7/1995 Luigi ..... 222/14
5,566,733 A * 10/1996 Germain ..... 141/192
5,665,226 A * 9/1997 Nishiyama ..... 210/141
6,460,367 B1 * 10/2002 DuHack ..... 62/337
6,532,758 B2 * 3/2003 DuHack ..... 62/340

FOREIGN PATENT DOCUMENTS

| | | |
|---|---|---|
| IT | 215 099 | 7/1990 |
| IT | 216 925 | 10/1991 |
| IT | 219 183 | 12/1992 |
| IT | 219 184 | 12/1992 |
| IT | 235 998 Y | 7/2000 |

* cited by examiner

*Primary Examiner*—Frederick C. Nicolas
(74) *Attorney, Agent, or Firm*—Sughrue Mion, PLLC

(57) ABSTRACT

The device comprises a valve body with an input adapted to be connected to a water supply source, and with at least a first and second output. The body is provided with at least a first and a second electrovalve with direct actuation, whose hydraulic inputs are interconnected with one another and are connected to the input of the valve body and whose outputs are independent or separate and are connected to the first and the second output of the body respectively. The body is provided with a third solenoid electrovalve, for safety purposes, interposed between the input of the body and the inputs of the first and second electrovalves. Control devices are coupled to this third electrovalve such that the latter may be opened/closed each time that the first or second electrovalve is opened/closed. This third electrovalve closes in a delayed manner with respect to the closure of the first and the second electrovalve.

7 Claims, 2 Drawing Sheets

ELECTROVALVE DISPENSER DEVICE FOR A REFRIGERATOR

BACKGROUND OF THE INVENTION

The present invention relates to an electrovalve dispenser device for refrigerators.

A device of this type according to the prior art is shown in diagram form in FIG. 1, where it is shown overall by 1. This device comprises a valve body 2, with an input 3 adapted to be connected to a water supply source (not shown) and with a first and a second output 4 and 5 connected to a heat exchanger 6 adapted to cool a flow of water flowing therethrough and respectively to a unit 7 adapted to produce ice, for instance in crushed or cubed form.

A first and a second solenoid electrovalve EV1 and EV2 preferably of the type that is normally closed (or of the bistable type) are provided and integrated in the valve body 2; the hydraulic inputs of these electrovalves are interconnected with one another and are connected to the general input 3 of the valve body 2. The outputs of the electrovalves EV1 and EV2 are independent, or separate, and are connected to the first and second outputs 4, 5 of the valve body 2.

The electrovalves EV1, EV2 are of the so-called direct actuation type, i.e. their actuation is not servo-assisted. In other words, in these valves the respective solenoid is able, when excited, directly to cause the displacement of a shutter which frees a valve seat enabling water to flow between the input and the output of the electrovalve.

The device 1 further comprises control means which are shown in diagram form in FIG. 1 as push-button switches 8 and 9 which are able, when actuated by a user, to cause an excitation of the electrovalve EV1 and the electrovalve EV2 respectively, in order to cause the supply of a flow of cooled water and, respectively, of ice in crushed or cubed form.

The device according to the prior art described above has the drawback that if, after the closure command, the electrovalve which has been open does not close again, the supply of water continues with the risk of flooding of the environment in which the refrigerator is located.

SUMMARY OF THE INVENTION

An object of the present invention is to provide an electrovalve dispenser device which enables this drawback to be remedied.

BRIEF DESCRIPTION OF THE DRAWINGS

Further characteristic features and advantages of the invention are set out in the following detailed description, given purely by way of non-limiting example, and made with reference to the accompanying drawings, in which.

DETAILED DESCRIPTION OF THE INVENTION

Figure 1:
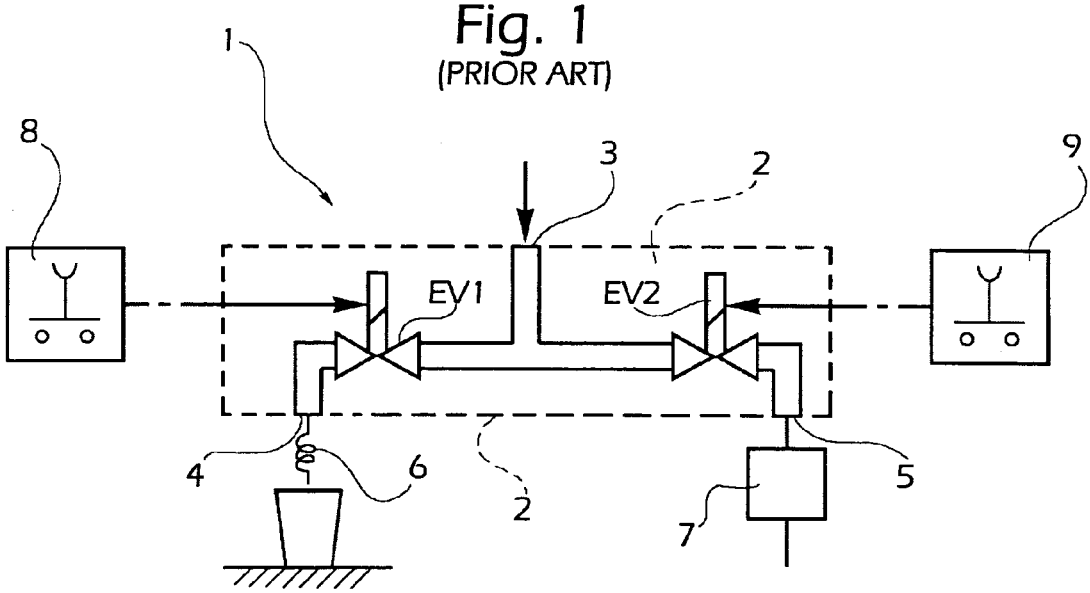
Fig. 1 (PRIOR ART)
FIG. 1, already described above, is a diagrammatic illustration of an electrovalve dispenser device of the prior art.
Figure 2:
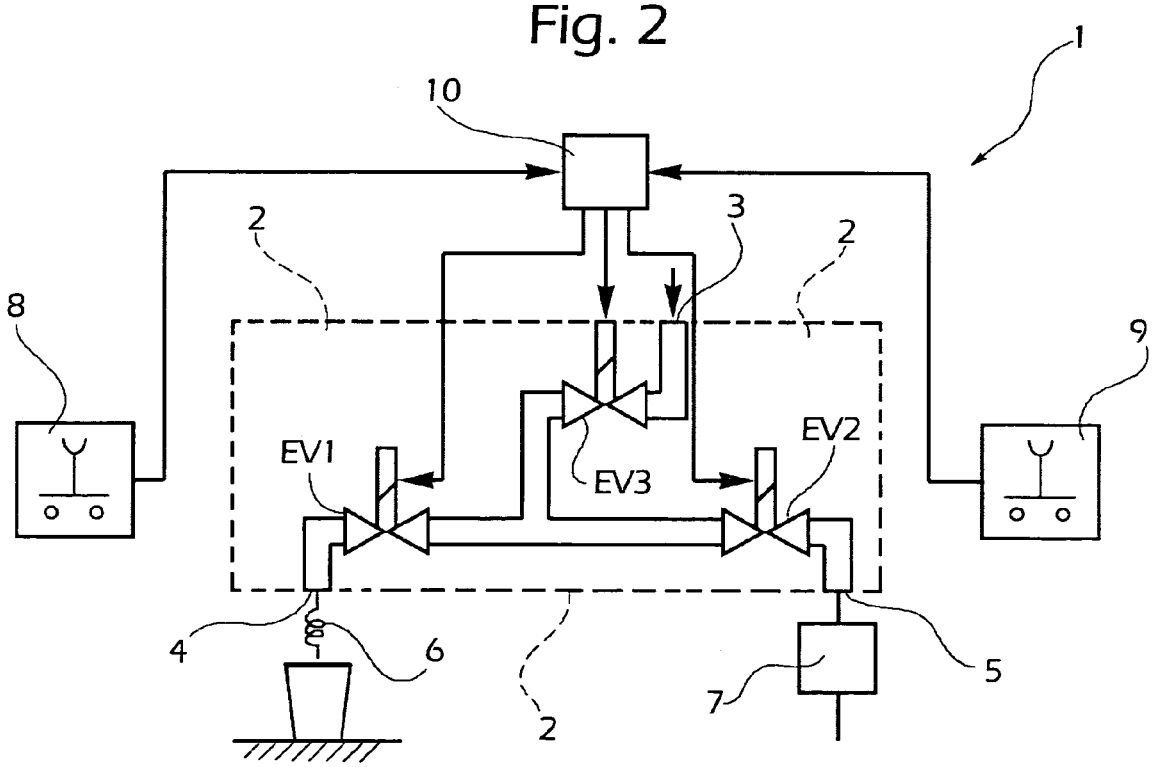
FIG. 2 is a diagrammatic illustration of an electrovalve dispenser device of the present invention.

In FIG. 2, components and members corresponding to those already described in relation to FIG. 1 are again given the same reference letters and/or numerals.

In the device 1 according to FIG. 2, a third solenoid electrovalve, preferably of the type which is normally closed or of bistable type, shown by EV3, is provided in the valve body 2 and is interposed between the input 3 of the valve body 2 and the inputs of the electrovalves EV1 and EV2.

The electrovalve EV3 is preferably of the indirectly actuated type, i.e. of the servo-assisted type, for instance of the type described and illustrated in the Italian Utility Model specifications 215 099, 219 183, 219-184 and 235 998. Moreover, this third electrovalve EV3 could also be of the direct type, i.e. with actuation that is not servo-assisted.

The arrangement is such that when a user actuates a control device 8 or 9, the associated electrovalve EV1 or EV2, and also the electrovalve EV3, is commanded to open. A flow of water from the source to the input 3 of the valve body 2 may thus be selectively supplied to the output 4 or the output 5 of the valve body 2.

The arrangement is, moreover, such that when the user releases the control device 8 or 9 that has been actuated, the third electrovalve EV3 is closed again in an delayed manner with respect to the closure of the electrovalve EV1 or EV2.

If the third electrovalve EV3 is of the indirect, or servo-assisted, actuation type, it is already intrinsically slower to close than a normal direct actuation valve, i.e. its switching time for closure is greater.

The delayed closure of the electrovalve EV3 may, moreover, also be obtained as a result of a delay provided in a known manner by hydraulic and/or mechanical and/or electrical means. This is particularly applicable when the electrovalve EV3 is of the direct actuation type.

The delayed closure of the electrovalve EV3 could, moreover, be caused electrically/electronically by a control circuit, shown by 10 in FIG. 2, to which the control devices 8 and 9 that can be actuated by the user are connected.

The presence of the safety electrovalve EV3 makes it possible to ensure that the flow of water through the dispenser device is intercepted even when the electrovalve EV1 or EV2 has not closed following its de-excitation.

Following the particular method of operation described above, and in particular the delayed closure of the electrovalve EV3, a certain quantity of water is "trapped" between the electrovalve EV1 or EV2 and the electrovalve EV3. This quantity of water could impede the subsequent re-opening of the electrovalve EV1 or EV2, especially when this valve is of low power.

In order to avoid this drawback, the device 1 is associated with a control device which comprises a circuit 10 connected to the solenoids of the three electrovalves EV1-EV3 and adapted to cause, after a closure of the electrovalve EV1 (or EV2) and the subsequent re-closure of the third electrovalve EV3, a re-opening of the electrovalve EV2 (or EV1) for a predetermined time in order to enable the discharge of the water trapped between the electrovalve EV1 (or EV2) and the electrovalve EV3. With reference to the example shown in FIG. 3, the re-opening of the electrovalve EV1 takes place at the preferred time.

Figure 3:
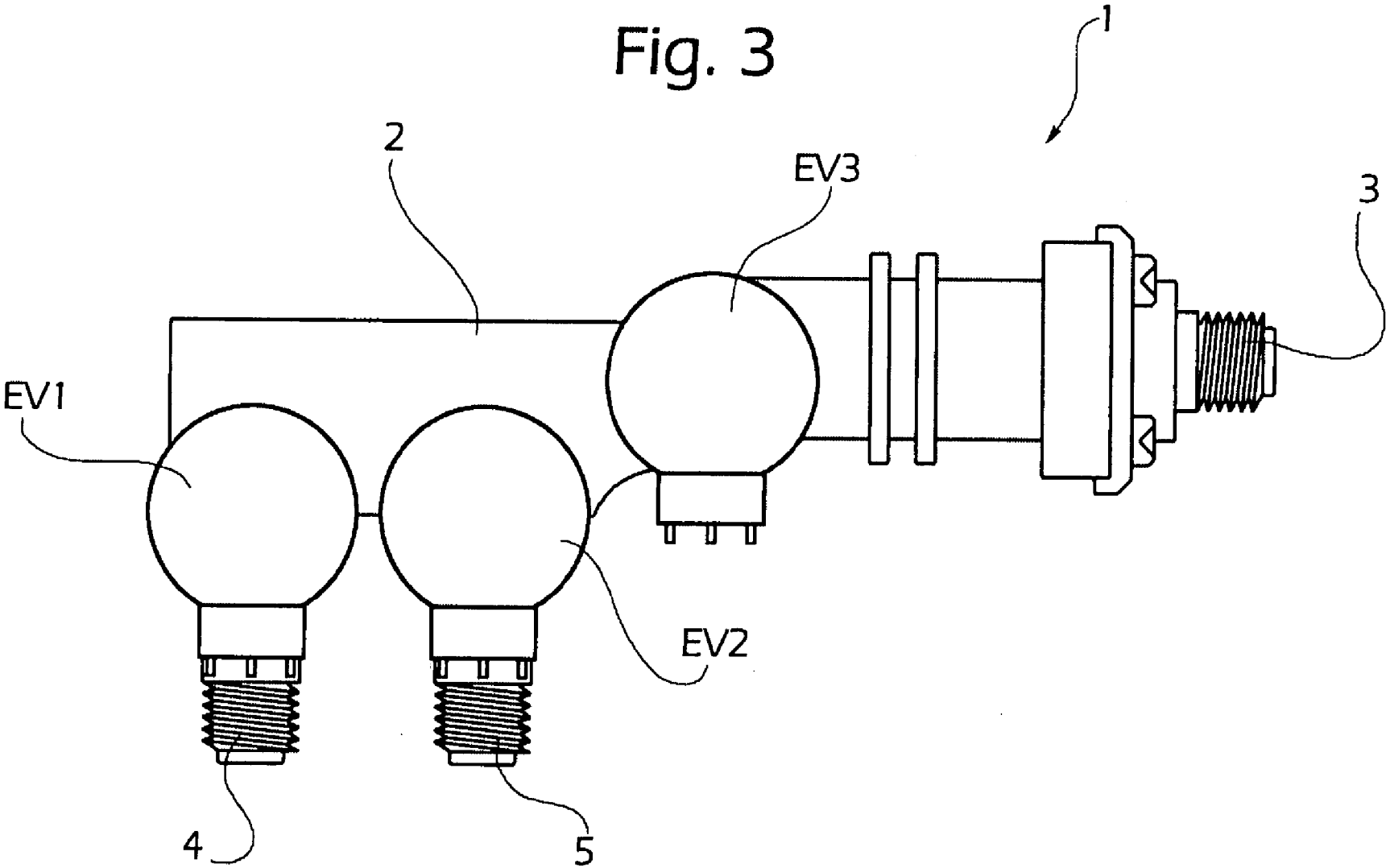
FIG. 3 is a diagrammatic plan view of a possible embodiment of a valve unit comprised in the dispenser device of the invention.

FIG. 3 is a diagram of an embodiment of the valve unit comprised in the device of the invention. In this embodiment, the valve body 2 is monolithic and forms at one end an inlet mouth 3 leading to the electrovalve EV3. The electrovalves EV1 and EV2 are integrated downstream thereof, in a further portion of the valve body 2, and their respective output mouths 4, 5, advantageously facing in the same direction, form the outputs of the overall device 1.

It will be appreciated that other geometric arrangements are possible.

The invention is not limited, moreover, to units in which the additional safety electrovalve, indicated above by EV3, is associated with more than two electrovalves. The electrovalve unit could for instance comprise a further output channel controlled by an electrovalve, in order to dispense water coming directly from the mains or demineralised water or even heated water. In such a case, one of the various electrovalves with which the safety electrovalve is associated could be re-opened momentarily for the evacuation of the "trapped" water.

Obviously, without prejudice to the principle of the invention, embodiments and constructional details could be widely varied with respect to what has been described and illustrated purely by way of non-limiting example, without thereby departing from the scope of the invention as set out in the accompanying claims.

What is claimed is:

1. An electrovalve dispenser device for a refrigerator, comprising a valve body with an input connected to a water supply source, and with at least a first and second output, the body being provided with at least a first and a second solenoid electrovalve with direct actuation, whose hydraulic inputs are interconnected with one another and are connected to the input of the valve body and whose outputs are independent or separate and are connected to the first and the second output of the valve body respectively, and control means actuated by a user to cause the selective opening of one and/or the other electrovalve, the valve body being provided with a third solenoid electrovalve, for safety purposes, interposed between the input of the valve body and the inputs of the first and second electrovalves, the control means being coupled to the third electrovalve such that the third electrovalve may be opened/closed each time that one of the first and second electrovalves is opened/closed, wherein the third electrovalve closes in a delayed manner with respect to the closure of the first and the second electrovalves.

2. A device as claimed in claim 1, wherein the electrovalves are of the a normally closed type or of a bistable type.

3. A device as claimed in claim 1, wherein the third electrovalve is of an indirect actuation or servo-assisted type.

4. A device as claimed in claim 3, wherein the third electrovalve has a switching time for closure greater than that of the first and second electrovalves.

5. A device as claimed in claim 1, wherein the closure of the third electrovalve is hydraulically and/or mechanically and/or electrically delayed.

6. A device as claimed in claim 1, wherein the control means are adapted to cause closure switching of the third electrovalve with a predetermined delay with respect to the first and second electrovalves.

7. A device as claimed in claim 1, wherein the control means are disposed to cause, after the closure of the first electrovalve or the second electrovalve, and a subsequent re-closure of the third electrovalve, a re-opening of the second electrovalve or the first electrovalve for a predetermined time.

* * * * *